US009770901B2

(12) United States Patent
Liao et al.

(10) Patent No.: US 9,770,901 B2
(45) Date of Patent: Sep. 26, 2017

(54) CONSTANT CURRENT MODE FIRING CIRCUIT FOR THERMAL INKJET-PRINTING NOZZLE

(71) Applicant: Hewlett-Packard Development Company, L.P., Houston, TX (US)

(72) Inventors: Hang Liao, Corvallis, OR (US); Richard R. Clark, Corvallis, OR (US); Galen H. Kawamoto, Corvallis, OR (US); Dennis J. Schloeman, Corvallis, OR (US); Bao Yeh, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/011,191

(22) Filed: Jan. 29, 2016

(65) Prior Publication Data

US 2016/0144618 A1 May 26, 2016

Related U.S. Application Data

(63) Continuation of application No. 11/134,015, filed on May 20, 2005, now Pat. No. 9,283,750.

(51) Int. Cl.
*B41J 2/045* (2006.01)

(52) U.S. Cl.
CPC ..... *B41J 2/04541* (2013.01); *B41J 2/0455* (2013.01); *B41J 2/0457* (2013.01); *B41J 2/0458* (2013.01); *B41J 2/04555* (2013.01)

(58) Field of Classification Search
CPC .. B41J 2/04541; B41J 2/0455; B41J 2/04555; B41J 2/0457; B41J 2/0458
See application file for complete search history.

(56) References Cited

U.S. PATENT DOCUMENTS

| | | | |
|---|---|---|---|
| 3,436,672 | A | 4/1969 | Delagrange |
| 4,752,790 | A | 6/1988 | Scardovi |
| 5,083,137 | A | 1/1992 | Badyal et al. |
| 5,257,042 | A | 10/1993 | Buhler |
| 5,644,342 | A | 7/1997 | Argyres |
| 5,681,764 | A | 10/1997 | Hess et al. |
| 5,767,872 | A | 6/1998 | Scardovi et al. |
| 5,821,960 | A | 10/1998 | Mitani |
| 6,161,924 | A | 12/2000 | Mitani et al. |
| 6,170,936 | B1 | 1/2001 | Ahne et al. |
| 6,299,292 | B1 | 10/2001 | Edwards |

(Continued)

FOREIGN PATENT DOCUMENTS

| | | |
|---|---|---|
| EP | 0816082 | 1/1998 |
| EP | 1241006 | 9/2002 |

(Continued)

*Primary Examiner* — Jason Uhlenhake
(74) *Attorney, Agent, or Firm* — Michael A. Dryja

(57) ABSTRACT

A firing circuit for a thermal inkjet-printing nozzle includes a heater resistor and a switch. The heater resistor heats ink to cause the ink to be ejected from the nozzle. The heater resistor has a first end and a second end, the second end connected to a ground. The switch controls activation of the heater resistor. The switch has a first end connected to a voltage source and a second end connected to the first end of the heater resistor. The switch operates in a constant current mode, such that an at least substantially constant current flows through the heater resistor upon activation.

15 Claims, 7 Drawing Sheets

(56) References Cited

U.S. PATENT DOCUMENTS

| | | | |
|---|---|---|---|
| 6,536,871 | B1 | 3/2003 | Haddick et al. |
| 6,729,707 | B2 | 5/2004 | Corrigan |
| 9,283,750 | B2 * | 3/2016 | Liao ..... B41J 2/04541 |
| 2003/0025740 | A1 | 2/2003 | Rehmann et al. |
| 2004/0066423 | A1 | 4/2004 | Samii |
| 2005/0195255 | A1 | 9/2005 | Shinada et al. |

FOREIGN PATENT DOCUMENTS

| | | |
|---|---|---|
| EP | 1142715 | 6/2004 |
| EP | 1384583 | 9/2005 |
| EP | 1881900 | 10/2008 |
| JP | 2001191531 | 7/2001 |

* cited by examiner

CONSTANT CURRENT MODE FIRING CIRCUIT FOR THERMAL INKJET-PRINTING NOZZLE

BACKGROUND

Thermal inkjet-printing devices, such as thermal inkjet printers, operate by appropriately ejecting ink from inkjet-printing nozzles to form images on media such as paper. Ink is ejected from a given inkjet-printing nozzle by using a firing circuit for the inkjet-printing nozzle. The firing circuit includes a heater resistor and a switch. When the switch is closed, current flows through the heater resistor, which heats ink and causes it to eject from the corresponding nozzle. Current firing circuit designs are known as "low-side switch" firing circuits, in which a side of the switch is always connected to a ground, and a side of the heater resistor is always connected to a voltage source. However, such designs can be problematic. If a heater resistor of a given nozzle fails, for instance, the resulting voltage leakage can damage other firing circuits.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
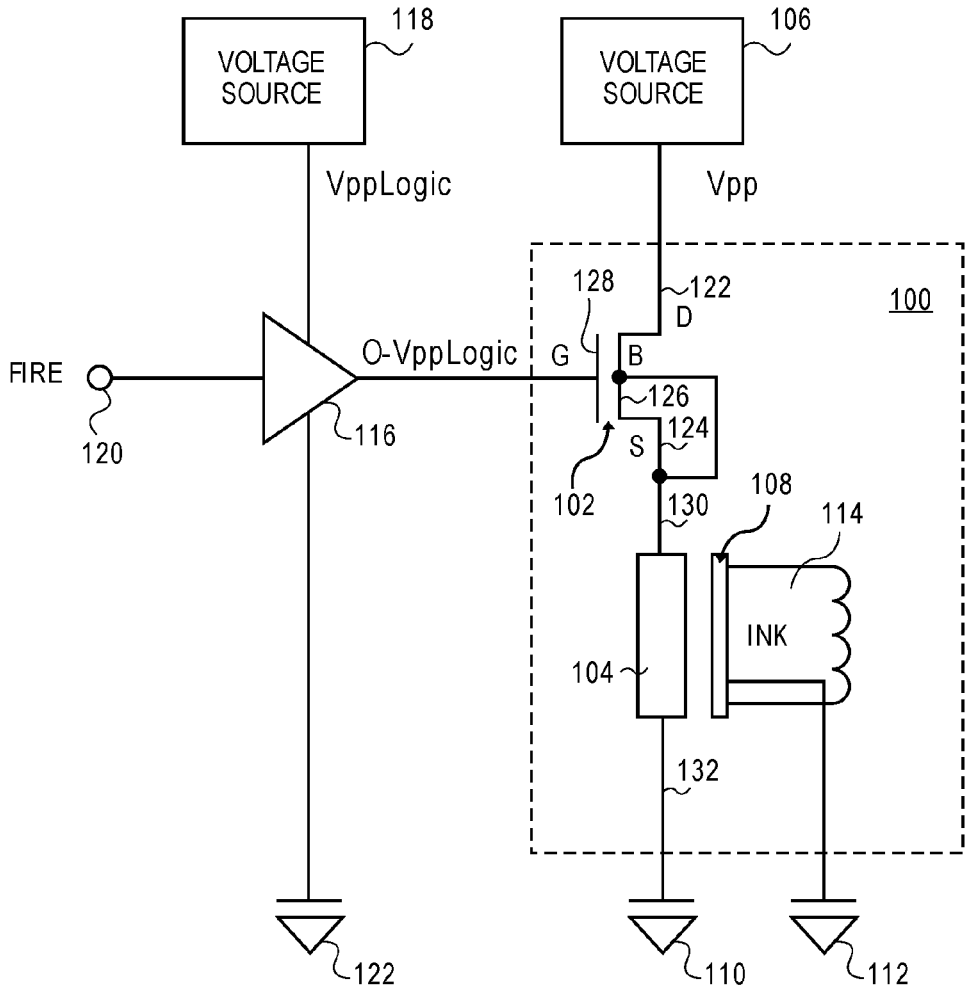
FIG. 1 is a diagram of a constant current mode firing circuit for an inkjet-printing nozzle, according to an embodiment of the invention.

FIG. 1 shows a firing circuit 100 for a thermal inkjet-printing nozzle, according to an embodiment of the invention. The firing circuit 100 includes a switch 102, and a heater resistor 104. Although the dotted lines defining the firing circuit 100 in FIG. 1 encompass a floating plate 108 that separates the heater resistor 104 from ink 114, the firing circuit 100 in one embodiment of the invention does not include the floating plate 108, and/or the ink 114. Furthermore, although the dotted lines defining the firing circuit 100 in FIG. 1 do not encompass a turn-on voltage circuit 116 that translates a firing logic signal at a pad 120 to a greater voltage, the firing circuit 100 in one embodiment of the invention can include the turn-on voltage circuit 116.

The switch 102 is in one embodiment a metal-oxide semiconductor (MOS) transistor, such as a laterally diffused MOS (LDMOS) transistor. The switch 102 has a first end 122 connected to a voltage source 106, and a second end 124 connected to the heater resistor 104. Because the switch 102 is connected to the voltage source 106, as opposed to, for instance, the heater resistor 104, the switch 102 is referred to as a high-side switch, and the firing circuit 100 is referred to as a high-side switch firing circuit.

Where the switch 102 is a transistor, such as a MOS and/or an LDMOS transistor, the transistor can have its drain D at the end 122 of the switch 102, its source S at the end 124 of the switch 102, a gate G also indicated as the gate 128, and a body B also indicated as the body 126 in FIG. 1. The drain is thus connected to the voltage source 106, and the source is thus connected to the heater resistor 104. The body 126 is further connected to the source, which in one embodiment allows the transistor to operate in a constant current mode, as will be described. A threshold voltage is defined between the gate and the source of the transistor.

The heater resistor 104 is also referred to as a thermal inkjet resistor. The heater resistor 104 has a first end 130 connected to the switch 102, and a second end 132 connected to a ground, or pull-down, 110. The plate 108 may be a tantalum plate, or another type of plate. The plate 108 is also connected to a ground, or pull-down, 112. The switch 102 controls activation of the heater resistor 104. When the switch 102 is turned on, an at least substantially constant current, as will be described, flows through the heater resistor 104. The heater resistor 104 heats the ink 114 on the other side of the plate 108, expanding the ink 114 and ultimately causing it to eject. When the heater resistor 104 has current flowing therethrough, it is said that the heater resistor 104 is activated, or is firing. As such, the switch 102 controls activation of the heater resistor 104.

The switch 102 is turned on when a voltage is applied to the gate 128 that is greater than the threshold voltage of the switch 102. In one embodiment, the turn-on voltage circuit 116 controls whether a voltage is applied to the gate 128. In particular, the turn-on voltage circuit 116 is connected between a voltage source 118 providing a voltage VppLogic and a ground 122. A firing logic signal is applied to the pad 120 when the thermal inkjet-printing nozzle to which the firing circuit 100 corresponds is to eject ink. The firing logic signal is a lower voltage than the voltage desired at the gate 128 of the switch 102. For instance, the firing logic signal may be five volts, whereas the voltage VppLogic may be 32 volts. As such, the turn-on voltage circuit 116 translates the lower voltage of the firing logic signal to the greater voltage VppLogic.

Therefore, when a high firing logic signal is present at the pad 120, such as five volts, the output of the turn-on voltage circuit 116 is the voltage VppLogic, such as 32 volts. The switch 102 is closed, causing current to flow through the heater resistor 104, and the ink 114 is ejected. When a low firing logic signal is present at the pad 120, such as zero volts, the output of the turn-on voltage circuit 116 is also zero volts. The switch 102 is open, and no current flows through the heater resistor 104. Therefore, none of the ink 114 is ejected.

The voltage source 106 provides a voltage Vpp that ideally is equal to or greater than the voltage VppLogic, but may be lower than the voltage VppLogic in some instances, as will be described in more detail. The switch 102 operates in a constant current mode, on account of at least one of two factors. First, the voltage Vpp provided by the voltage source 106 is not less than the voltage VppLogic that is applied at the gate 128 of the switch 102 by more than the threshold voltage of the switch 102. For example, the threshold voltage of the switch 102 may be 1.2 volts. Therefore, if the voltage VppLogic is 32 volts, this means that the voltage Vpp is not less than 32−1.2=30.8 volts. Thus, the voltage Vpp not being less than the voltage VppLogic by more than a threshold voltage—and in some embodiments the voltage Vpp actually being equal to or greater than the voltage VppLogic—ensures that the switch 102 operates in a constant current mode. Second, the body 126 of the switch 102 is connected to the source at the end 124 of the switch 102.

Having the switch 102 operate in a constant current mode means that the current flowing through the heater resistor 104 when it is activated (i.e., when it is firing) is substantially at the same level. Stated another way, the switch 102 operating in a constant current mode means that at least substantially constant current flows through the heater resistor 104 upon activation. The voltage at the end 130 of the heater resistor 104 tracks the voltage at the gate 128 of the switch 102, regardless of changes to the voltage Vpp at the drain of the switch 102 such that the voltage at the end 130 of the heater resistor 104 is equal to the voltage at the gate 128 minus the threshold voltage of the switch 102. The threshold voltage of the switch 102 is the voltage between the gate 128 and the source of the switch 102 when the switch has been turned on.

The voltage at the end 130 of the heater resistor 104 is therefore said to be regulated, owing to the switch 102 operating in a constant current mode, and the switch 102 being in a source follower configuration, or a source follower mode, in which the voltage at the source tracks or follows the voltage at the gate 128. That is, the source follower mode in which the switch 102 operates provides for the switch 102 operating in a constant current mode in one embodiment. Where the ground 110 is a local, unregulated ground, the end 132 of the heater resistor 104 is unregulated. However, where the ground 110 is an absolute, regulated ground, the end 132 of the heater resistor 104 is regulated to zero volts. When the heater resistor 104 is not activated and is not firing, it is at a voltage level at least substantially equal to the voltage level at which the ink 114 is at, since the plate 108, and thus the ink, is connected to the local ground 112. As a result, if the heater resistor 104 malfunctions, just the firing circuit 100 and the inkjet-printing nozzle to which the firing circuit 100 corresponds are affected, and not any neighboring firing circuits and nozzles.

Figure 2:
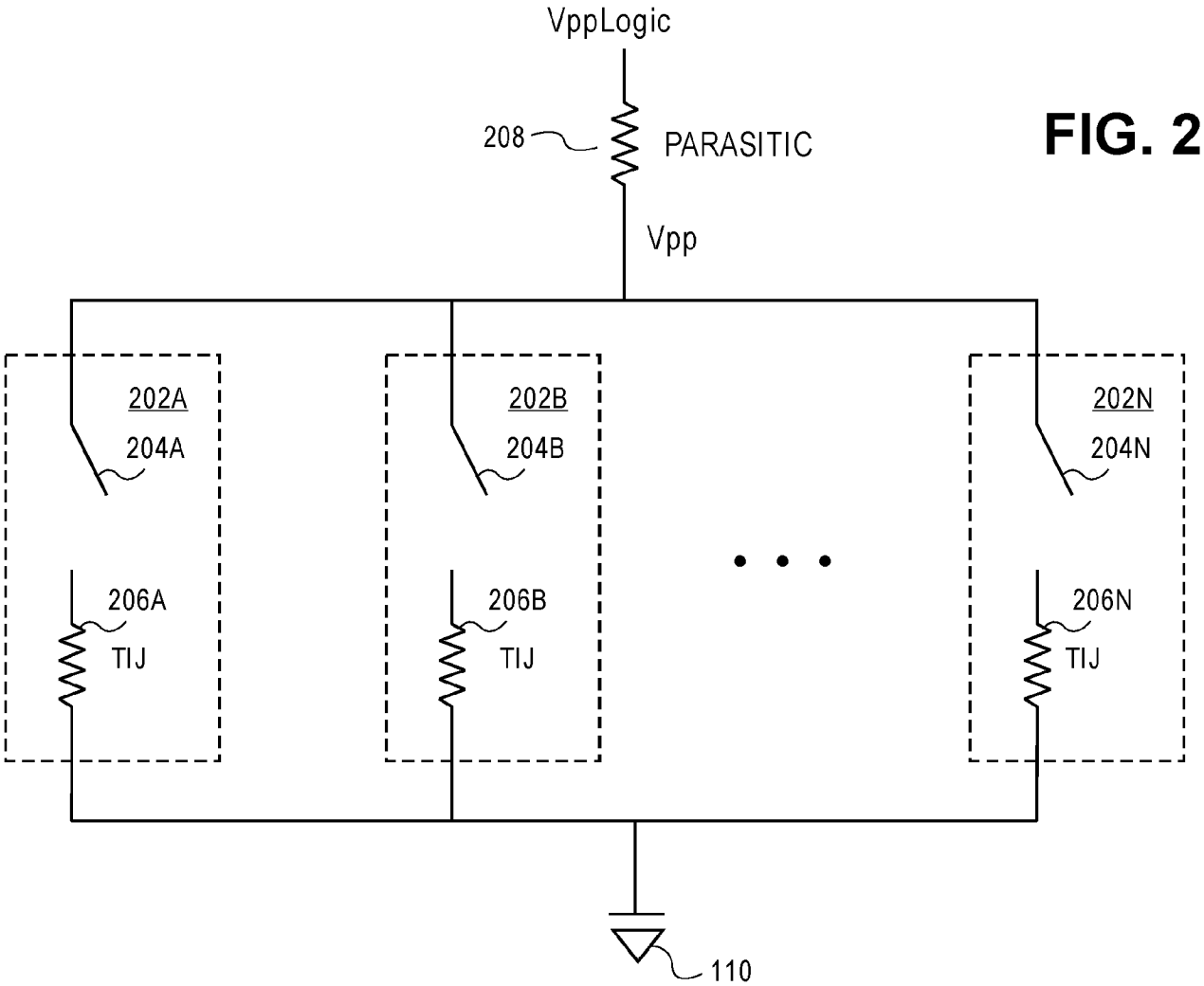
FIG. 2 is a diagram depicting the parasitic resistance that results from a number of firing circuits concurrently firing, according to an embodiment of the invention.

FIG. 2 shows why the voltage Vpp may be less than the voltage VppLogic, according to an embodiment of the invention, such that constant current mode operation of the high side switch firing circuit is beneficial. FIG. 2 specifically shows a number of firing circuits 202A, 202B, . . . , 202N, collectively referred to as the firing circuits 202. The firing circuits 202 may each be exemplified as the firing circuit 100 of FIG. 1. As such, the firing circuits 202 have high-side switches 204A, 204B, . . . , 204N, collectively referred to as the switches 204, and heater resistors 206A, 206B, . . . , 206N, collectively referred to as the heater resistors 206. There may be 88, or more, of the firing circuits 202.

The voltage VppLogic is substantially constant, such as at 32 volts. The voltage Vpp, however, is lower than the voltage VppLogic, because of a parasitic resistance 208. The parasitic resistance 208 increases based on the number of the firing circuits 202 that are currently firing. That is, the parasitic resistance 208 increases based on the number of the switches 204 that are currently closed, and thus the parasitic resistance 208 increases based on the number of the heater resistors 206 that are currently activated and are firing. Therefore, the voltage Vpp, provided by the voltage source 106 in FIG. 1, is lowered based on the number of the firing circuits 202 that are concurrently firing.

In such situations, having the switches 204 operate in a constant current mode ensures that the voltage over the heater resistors 206, and thus the current through the heater resistors 206, is regulated, regardless of the drop in the voltage Vpp. It is noted that the voltage Vpp should not drop by more than a threshold voltage below the voltage VppLogic that is used to turn on the switches 204, however, to ensure that the switches 204 remain in the constant current mode, as has been described. Thus, operation of the switches 204 in the constant current mode regulates the voltage over and the current through the heated resistors 206, which is advantageous.

It is noted that particularly having the voltage Vpp being greater than the voltage VppLogic by more than a threshold voltage (as opposed to just having the voltage Vpp not being less than the voltage VppLogic by more than a threshold voltage) effectively minimizes the impact of parasitic resistances to the firing circuits 202. Furthermore, during design of the firing circuits 202, the parasitic resistances can be concentrated as or to the parasitic resistances 208 depicted in FIG. 2. Other parasitic resistances, such as those at or near the ground 110, which are not shown in FIG. 2, are by comparison minimized during the design of the firing circuits 202.

Figure 3:
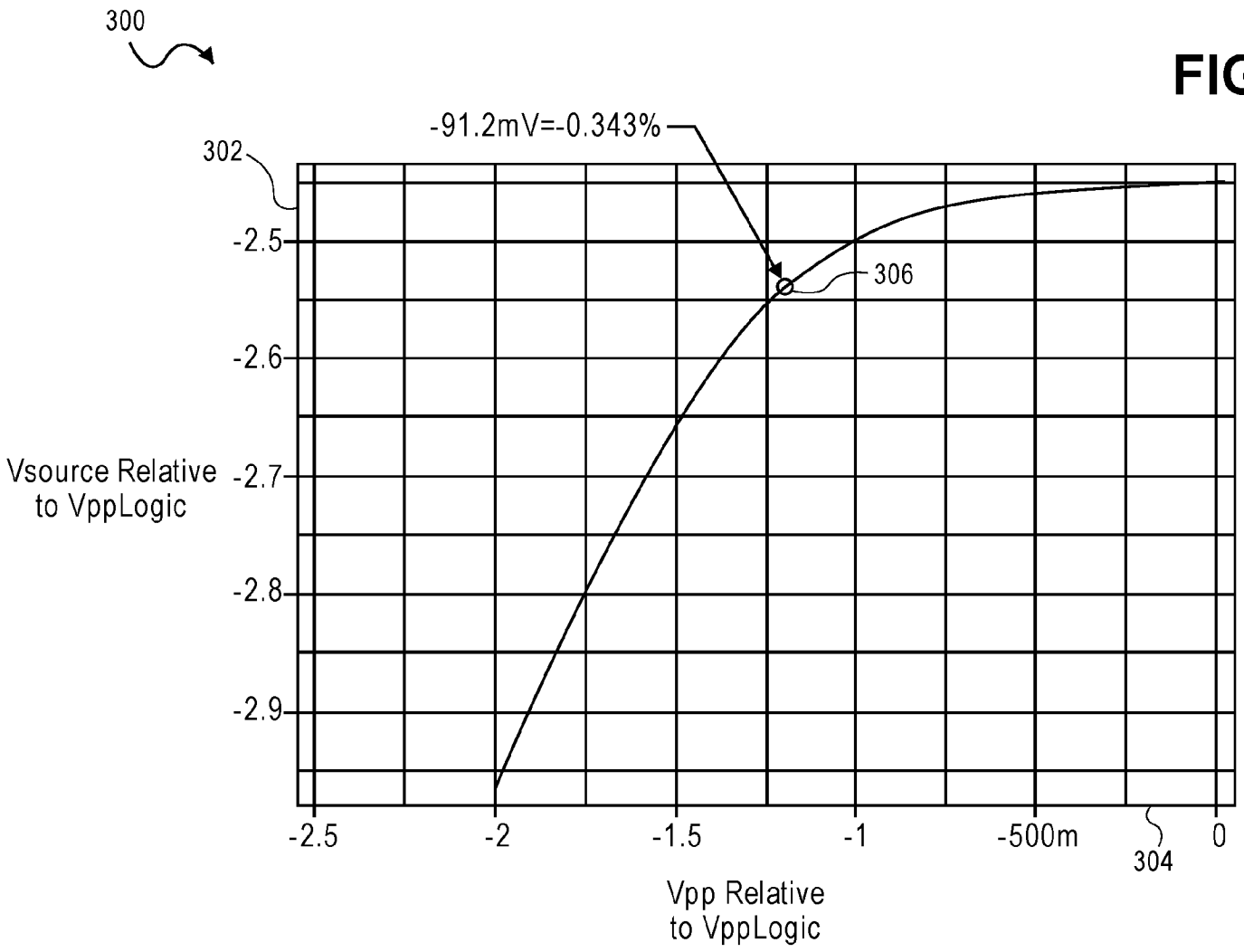
FIG. 3 is a graph depicting the direct current (DC) characterization of a constant current mode, high-side switch, according to an embodiment of the invention.

FIG. 3 shows a graph 300 that depicts the direct current (DC) characterization of the switch 102 of FIG. 1 when it operates in a high-side, constant current mode configuration, according to an embodiment of the invention. The y-axis 302 denotes the voltage at the source of the switch 102, Vsource, relative to the voltage VppLogic provided at the gate 128 of the switch 102. That is, the y-axis 302 represents how much the voltage Vsource drops below VppLogic. The x-axis 304 denotes the voltage Vpp at the drain of the switch 102 relative to the voltage VppLogic. That is, the x-axis 304 denotes how much the voltage Vpp drops below VppLogic, simulating the parasitic resistance 208 of FIG. 2 that has been described, which increases when more of the firing circuits 202 are fired. In the example of FIG. 3, the voltage VppLogic is held at 29 volts.

Therefore, as depicted at the point 306 in the graph 300, the voltage Vsource drops just 91.2 millivolts (mV), or 0.343%, for a 1.2 volt drop in the voltage Vpp. However, if the entire 1.2 volt drop in the voltage Vpp were seen at the end 130 of the resistor 104, then there would have been a greater drop of 4.5%. As such, the constant current mode operation of the switch 102 is beneficial, because it provides for such voltage regulation at the source of the switch 102, and thus at the end 130 of the heater resistor 104.

As can be seen in the graph 300, when the voltage Vpp drops by more than 1.2 volts, the voltage Vsource tracks the voltage Vpp nearly volt-for-volt. This is the region in which the voltage VppLogic exceeds the voltage Vpp by more than the threshold voltage of the switch 102. Thus, for effective regulation of the voltage Vsource, the switch 102 is to operate in a constant current mode, such that the voltage Vpp is not less than the voltage VppLogic by more than the threshold voltage of the switch 102.

Figure 4:
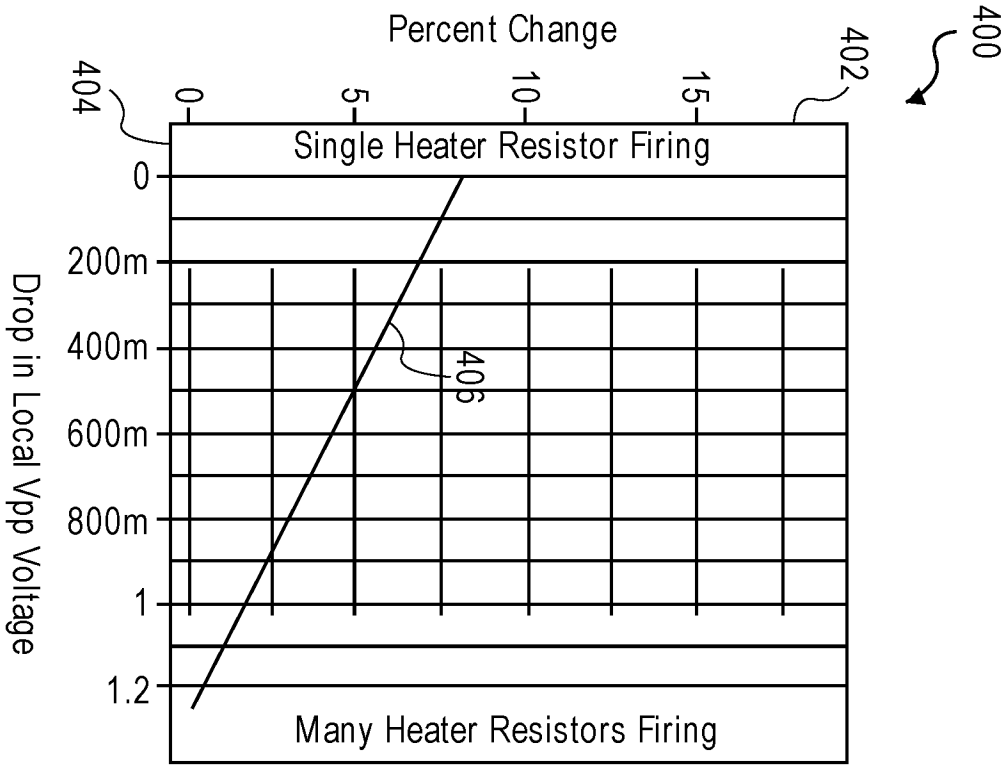
FIG. 4 is a graph depicting the alternating current (AC) characterization of a constant current mode, high-side switch, according to an embodiment of the invention.

FIG. 4 shows a graph 400 that depicts the alternating current (AC) characterization of the switch 102 of FIG. 1 when it operates in a high-side, constant current mode configuration, according to an embodiment of the invention. The y-axis 402 denotes the percent change in the energy delivered to a single heater resistor when the resistor is turned on, or activated, for one microsecond. The x-axis 404 denotes the drop in the voltage Vpp relative to the voltage VppLogic that results due to a single heater resistor or firing circuit firing, on the left side of the graph 400, and due to a large number of heater resistors or firing circuits firing, on the right side of the graph 400.

The drop in the voltage Vpp is again due to the parasitic resistance 208 that has been described. So that the switch 102 operates in a constant current mode, the maximum drop in the voltage Vpp compared to the voltage VppLogic is one threshold voltage of the switch 102, or 1.2 volts in the example of FIG. 4, which occurs when a large number of heater resistors are firing, or activated. By comparison, when just a single heater resistor is firing, or is activated, the drop in the voltage Vpp compared to the voltage VppLogic is nearly zero volts.

The line 406 of the graph 400 depicts the percentage change in the energy delivered to the heater resistor 104 when the heater resistor 104 is fired, when the switch 102 is operating in a constant current mode. Where the right side of the line 406 is set at a base line of zero percent, there is an 8.2% increase in the energy delivered to the heater resistor 104 when just one heater resistor is firing, as compared to many heater resistors firing. This is as compared to a low-side switch configuration, in which there can be an 18.8% increase in the energy delivered to the heater resistor 104 when just one heater resistor is firing, as compared to many heater resistors firing. Thus, the constant current mode, high-side switch configuration of the firing circuit 100 provides for better regulation in the energy delivered to the heater resistor 104 during firing, regardless of the number of firing circuits or heater resistors that are firing.

Figure 5:
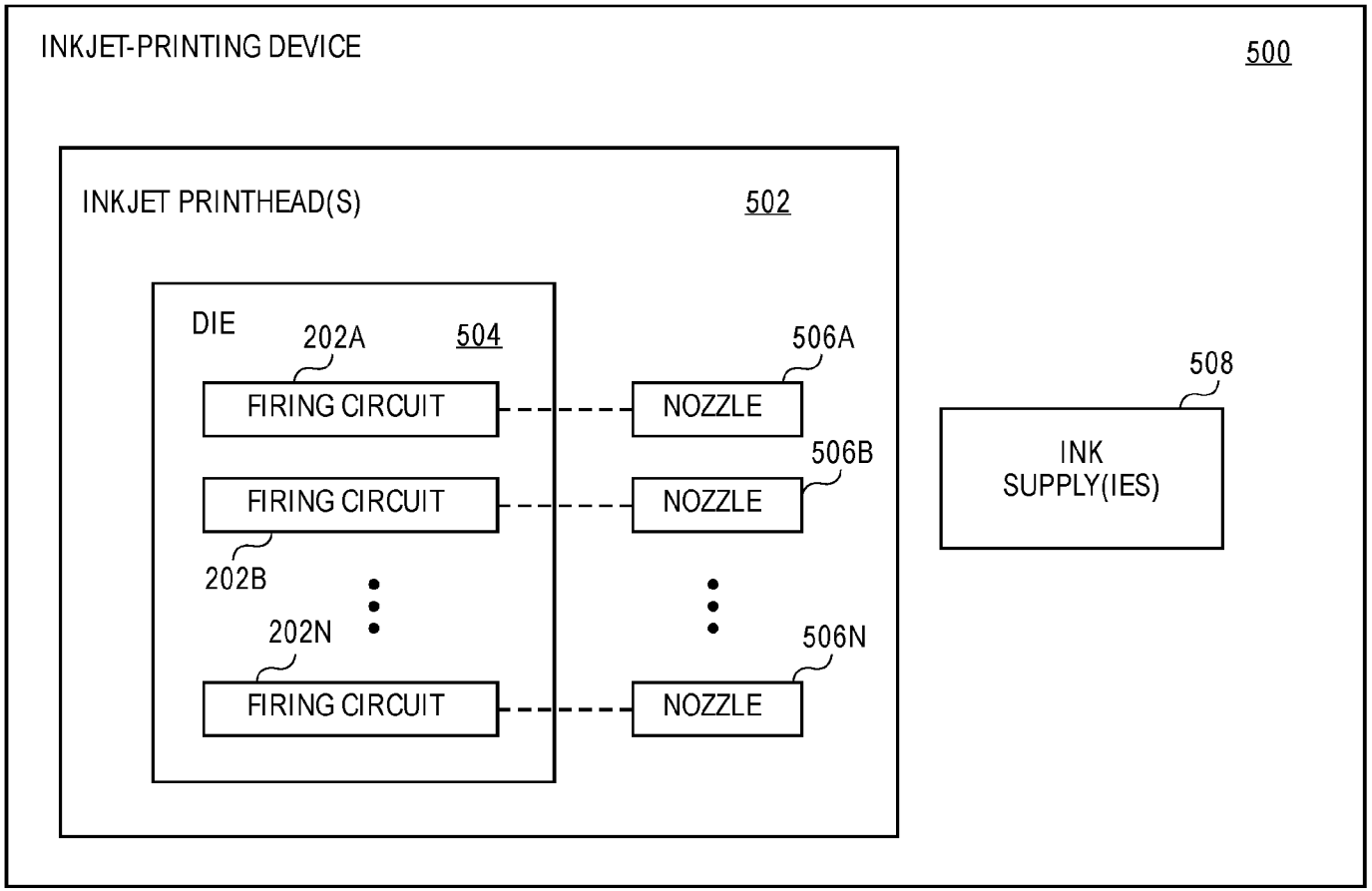
FIG. 5 is a block diagram of a representative inkjet-printing device, according to an embodiment of the invention.

FIG. 5 shows a block diagram of a representative inkjet-printing device 500 that can include the constant current mode, high-side switch firing circuits that have been described, according to an embodiment of the invention. The inkjet-printing device 500 may be an inkjet printer, for example. The inkjet-printing device 500 is depicted as including one or more inkjet printheads 502, and one or more ink supplies 508. As can be appreciated by those of ordinary skill within the art, the inkjet-printing device 500 may and typically will include other components, in addition to those depicted in FIG. 5.

The inkjet printheads 502 include one or more dies 504, and a number of thermal inkjet-printing nozzles 506A, 506B, . . . , 506N, collectively referred to as the inkjet-printing nozzles 506. The dies 504 are semiconductor or other types of substrates on which the firing circuits 202 that have been described are fabricated. The inkjet-printing nozzles 506 correspond to the firing circuits 502. Thus, each of the firing circuits 502 controls the ejection of ink from a corresponding one of the nozzles 506. The ink is provided from the ink supplies 508. The ink supplies 508 can in one embodiment be integrated with the inkjet printheads 502, as part of inkjet cartridges, which is not specifically depicted in FIG. 5.

Figure 6:
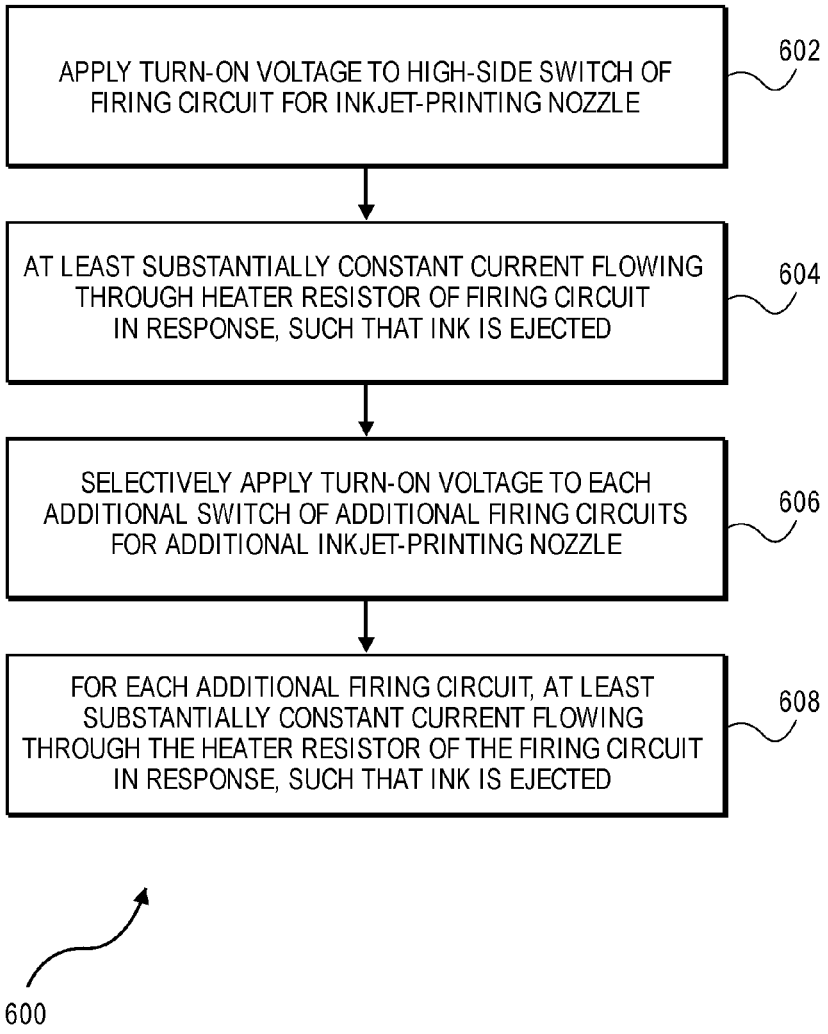
FIG. 6 is a flowchart of a method of use for a high-side switch, constant current mode firing circuit for a thermal inkjet-printing nozzle, according to an embodiment of the invention.

FIG. 6 shows a method 600 for using one or more constant current mode, high-side switch firing circuits that have been described, according to an embodiment of the invention. The needed turn-on voltage is applied to the high-side switch of a firing circuit for an inkjet-printing nozzle (602). For example, a lower-voltage firing logic signal may be asserted, which is translated to the higher turn-on voltage that is applied to the high-side switch of the firing circuit. In response, at least substantially constant current flows through the heater resistor of the firing circuit, such that ink is ejected from the thermal inkjet-printing nozzle to which the firing circuit corresponds (604).

The basic process of 602 and 604 is more generally performed for all of the firing circuits of an inkjet printhead. For instance, the turn on-voltage is selectively applied to each additional high-side switch of additional firing circuits for additional thermal inkjet-printing nozzles (606). As a result, for each additional firing circuit that is fired, at least substantially constant current flows through the heater resistor of the firing circuit in response, causing ink to be ejected from the corresponding inkjet-printing nozzle (608).

Figure 7:
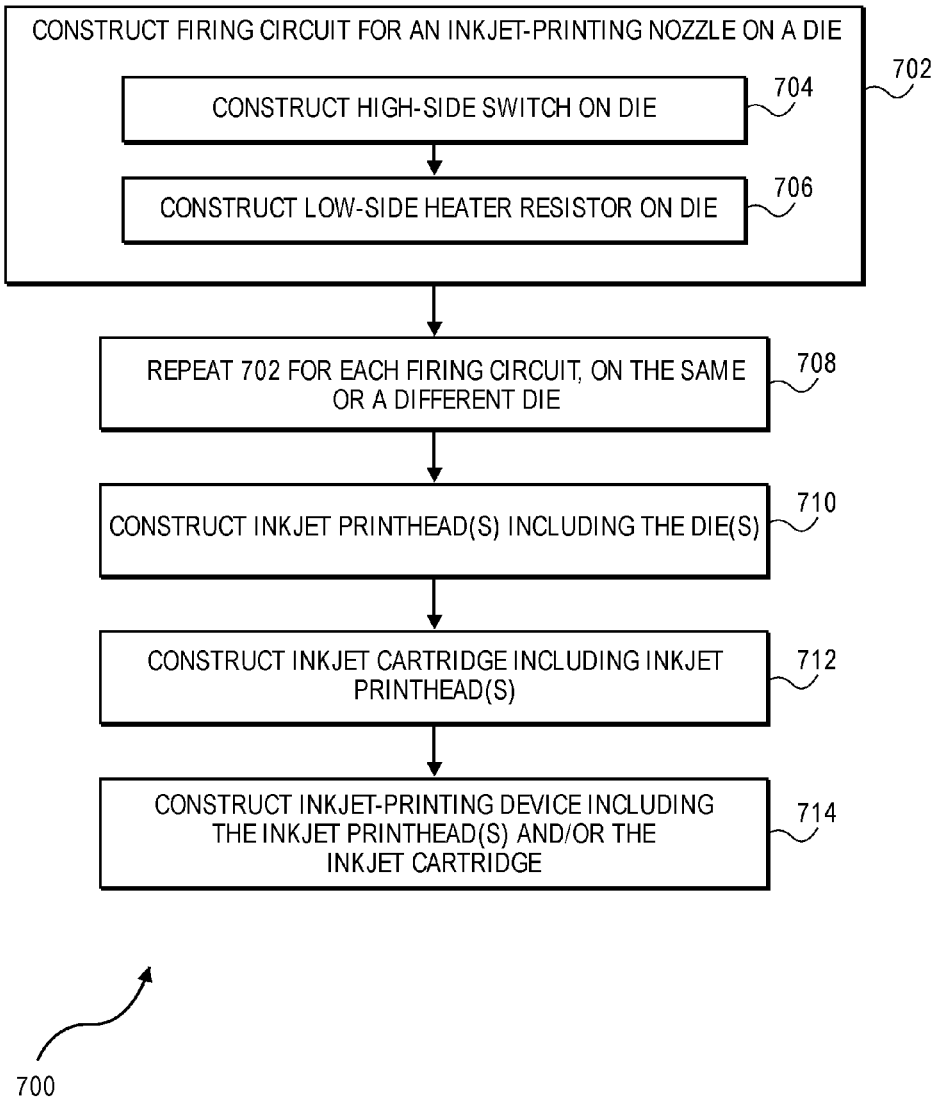
FIG. 7 is a flowchart of a rudimentary method of manufacture up to and including an inkjet-printing device, according to an embodiment of the invention.

FIG. 7 shows a rudimentary method of manufacture 700, according to an embodiment of the invention. First, a firing circuit is constructed for a thermal inkjet-printing nozzle, on a die (702). This includes constructing a high-side switch on the die (704) and a low-side heater resistor on the die (706). The firing circuit constructed is thus the constant current mode, high-side switch firing circuit that has been described. Additional firing circuits are further constructed on the same or different dies (708).

Inkjet printheads may then be constructed, using these dies (710). In one embodiment, inkjet cartridges may be constructed that include these inkjet printheads (712), and which can include supplies of ink. Finally, an inkjet-printing device may be constructed that includes the inkjet printheads and/or the inkjet cartridges that have been constructed (714). The inkjet-printing device may be an inkjet printer, or another type of inkjet-printing device.

It is noted that, although specific embodiments have been illustrated and described herein, it will be appreciated by those of ordinary skill in the art that any arrangement calculated to achieve the same purpose may be substituted for the specific embodiments shown. This application is thus intended to cover any adaptations or variations of embodiments of the present invention. Therefore, it is manifestly intended that this invention be limited only by the claims and equivalents thereof.

We claim:

1. An inkjet-printing device comprising:

a plurality of inkjet-printing nozzles;

a plurality of firing circuits corresponding to the inkjet-printing nozzles;

a voltage source at which a parasitic resistance of the firing circuits is concentrated;

a ground, wherein each firing circuit comprising:

a heater resistor to heat ink to cause the ink to be ejected from the nozzle, the heater resistor having a first end and a second end, the second end connected to the ground; and, a switch to control activation of the heater resistor, the switch having a first end connected to a voltage source and a second end connected to the first end of the heater resistor, wherein the switch operates in a constant current mode, such that an at least substantially constant current flows through the heater resistor upon activation, wherein the switch is a transistor having a gate, a body, a drain, and a source, the source being the second end of the switch connected to the first end of the heater resistor, the drain being the first end of the switch connected to the voltage source, the body connected to the source, and a turn-on voltage applied to the gate of the transistor to control activation of the heater resistor, wherein a voltage at the first end of the heater resistor tracks a voltage at the gate, and a current through the heater resistor remains constant, regardless of any fluctuation to voltage provided by the voltage source at the drain; and a controller to selectively activate the firing circuits to cause the inkjet-printing nozzles to eject ink, such that for each firing circuit that is activated a difference between a voltage at the gate of the transistor and a voltage at the drain of the transistor is less than or equal to a voltage between the gate of the transistor and the source of the transistor, regardless of the parasitic resistance decreasing the voltage at the drain of the transistor, the parasitic resistance based on and increasing in correspondence with a number of the firing circuits that are currently firing, wherein the switch is a transistor having a drain at the first end, a source at the second end, and a gate connected to a turn-on voltage circuit, a threshold voltage of the transistor defined between the gate and the source, and wherein a voltage at the turn-on voltage circuit to turn on the switch to activate the heater resistor is greater than a voltage at the voltage source by at most the threshold voltage of the transistor, so that operation of the switch remains in the constant current mode.

2. The inkjet-printing device of claim 1, wherein operation of the switch in the constant current mode causes the heater resistor to have a voltage at the first end thereof regulated.

3. The inkjet-printing device of claim 1, wherein the ground to which the second end of the heater resistor is connected is a local ground, such that a voltage at the second end of the heater resistor is unregulated.

4. The inkjet-printing device of claim 1, wherein the ground to which the second end of the heater resistor is connected is an absolute ground, such that a voltage at the second end of the heater resistor is regulated to zero volts.

5. The inkjet-printing device of claim 1, wherein the switch operates in a source follower mode so that operation of the switch remains in the constant current mode.

6. The inkjet-printing device of claim 1, wherein a voltage at the voltage source is greater than or equal to a voltage at the turn-on voltage circuit to turn on the switch to activate the heater resistor, so that operation of the switch remains in the constant current mode.

7. The inkjet-printing device of claim 1, further comprising the turn-on voltage circuit to translate a firing logic signal to a greater voltage needed to turn on the switch to activate the heater resistor.

8. The inkjet-printing device of claim 1, wherein the transistor is a laterally diffused metal-oxide semiconductor (LDMOS) transistor.

9. The inkjet-printing device of claim 1, further comprising a conductive plate disposed next to the heater resistor, the conductive plate in physical contact with the ink, the conductive plate being connected to the second ground so that the ink is electrically connected to the second ground.

10. The inkjet-printing device of claim 1, wherein the parasitic resistance is a first parasitic resistance, a second parasitic resistance at the ground minimized as compared to the first parasitic resistance.

11. An inkjet-printing device comprising:

an inkjet-printing nozzle;

a firing circuit corresponding to the inkjet-printing nozzle;

a voltage source at which a first parasitic resistance of the firing circuit is concentrated;

a ground at which a second parasitic resistance of the firing circuit is minimized in comparison to the first parasitic resistance;

a heater resistor to heat ink to cause the ink to be ejected from the nozzle, the heater resistor having a first end and a second end, the second end connected to a ground;

a switch to control activation of the heater resistor via a turn-on voltage being applied to the switch, the switch having a first end connected to a voltage source and a second end connected to the first end of the heater resistor, wherein the switch operates in a constant current mode, such that an at least substantially constant current flows through the heater resistor upon activation, wherein the switch is a transistor having a drain at the first end, a source at the second end, and a gate connected to a turn-on voltage circuit, a threshold voltage of the transistor defined between the gate and the source when the transistor is on, wherein the transistor further has a body connected to the source of the transistor; and a controller to selectively active the firing circuit to cause the inkjet-printing nozzle to eject ink such that a difference between a voltage at the gate of the transistor and a voltage at the drain of the transistor is less than or equal to the threshold voltage, wherein the switch is a transistor having a drain at the first end, a source at the second end, and a gate connected to a turn-on voltage circuit, a threshold voltage of the transistor defined between the gate and the source, and wherein a voltage at the turn-on voltage circuit to turn on the switch to activate the heater resistor is greater than a voltage at the voltage source by at most the threshold voltage of the transistor, so that operation of the switch remains in the constant current mode.

12. The inkjet-printing device of claim 11, further comprising a conductive plate disposed next to the heater resistor, the conductive plate in physical contact with the ink, the conductive plate being connected to the second ground so that the ink is electrically connected to the second ground.

13. The inkjet-printing device of claim 11, wherein a voltage at the first end of the heater resistor tracks a voltage at the gate, and a current through the heater resistor remains constant, regardless of any fluctuation to voltage provided by the voltage source at the drain.

14. The inkjet-printing device of claim 11, wherein the transistor is a laterally diffused metal-oxide semiconductor (LDMOS) transistor.

15. The inkjet-printing device of claim 11, wherein the parasitic resistance is a first parasitic resistance, a second parasitic resistance at the ground minimized as compared to the first parasitic resistance.

* * * * *